US010323447B2

(12) United States Patent
Haab et al.

(10) Patent No.: US 10,323,447 B2
(45) Date of Patent: Jun. 18, 2019

(54) ADJUSTABLE GUIDE DEVICE FOR A SLIDING ELEMENT

(71) Applicant: HAWA SLIDING SOLUTIONS AG, Mettmenstetten (CH)

(72) Inventors: Gregor Haab, Allenwinden (CH); Sascha Justl, Zürich (CH); Peter Ettmüller, Johen (CH); Nejib Yezza, Rickenbach b. Schwyz (CH)

(73) Assignee: HAWA SLIDING SOLUTIONS AG, Mettmenstetten (CH)

( * ) Notice: Subject to any disclaimer, the term of this patent is extended or adjusted under 35 U.S.C. 154(b) by 0 days.

(21) Appl. No.: 15/933,002

(22) Filed: Mar. 22, 2018

(65) Prior Publication Data

US 2018/0274275 A1 Sep. 27, 2018

(30) Foreign Application Priority Data

Mar. 23, 2017 (EP) ..... 17162589

(51) Int. Cl.
*E05D 15/00* (2006.01)
*E05D 15/06* (2006.01)

(52) U.S. Cl.
CPC ..... *E05D 15/0669* (2013.01); *E05D 15/0656* (2013.01); *E05D 15/0665* (2013.01);
(Continued)

(58) Field of Classification Search
CPC ..... E05Y 2900/132; E05Y 2900/148; E05Y 2201/684; E05Y 2201/692;
(Continued)

(56) References Cited

U.S. PATENT DOCUMENTS 2,026,955 A * 1/1936 Weigele ..... E05F 7/04 16/104
3,182,350 A * 5/1965 Witten ..... E05D 15/063 16/105

(Continued)

FOREIGN PATENT DOCUMENTS

JP 11022286 A * 1/1999
JP 2001152729 A * 6/2001
WO 2012031313 A1 3/2012

OTHER PUBLICATIONS

Sep. 21, 2017 Extended Search Report issued in European Patent Application No. 17162589.0.

*Primary Examiner* — Chuck Y Mah
(74) *Attorney, Agent, or Firm* — Oliff PLC

(57) ABSTRACT

An adjustable guide device, which serves for guiding a sliding element, such as a sliding door, with a mounting body that is mountable on the floor, a guide member that is pivotally connected to the mounting part and is designed for interacting with the lower side of the sliding element, and a locking element, with which the connection between the mounting part and the guide member is fixable or releasable. The guide member comprises a guide body and a guide foot, which are connected with one another, which guide body comprises a guide column that is aligned along a guide axis (y) and which guide foot is seated on an upper side of the mounting body and is pivotally connected by a joint element to the mounting body so that the guide foot can be turned around a pivot axis (x), which is distant from the guide axis (y).

15 Claims, 6 Drawing Sheets

(52) U.S. Cl.
CPC ..... *E05D 15/0621* (2013.01); *E05D 15/0691* (2013.01); *E05Y 2201/684* (2013.01); *E05Y 2201/692* (2013.01); *E05Y 2600/12* (2013.01); *E05Y 2600/14* (2013.01); *E05Y 2600/32* (2013.01); *E05Y 2600/324* (2013.01); *E05Y 2600/452* (2013.01); *E05Y 2900/132* (2013.01); *E05Y 2900/148* (2013.01)

(58) Field of Classification Search
CPC ..... E05Y 2201/688; E05Y 2201/64; E05Y 2201/612; E05Y 2201/614; E05Y 2600/10; E05Y 2600/14; E05Y 2600/32; E05Y 2600/324; E05Y 2600/452; E05D 15/0626; E05D 15/063; E05D 15/0621; E05D 15/0634; E05D 15/0632; E05D 15/0656; E05D 15/0665; E05D 15/0669; E05D 15/0691; E05D 13/00; E05D 13/003; Y10T 16/364; Y10T 16/3813; Y10T 16/3837; Y10T 16/384; Y10T 16/3825
See application file for complete search history.

(56) References Cited

U.S. PATENT DOCUMENTS 3,287,759 A * 11/1966 Foltz ..... E05D 15/063 16/87 R
3,526,995 A * 9/1970 Saunders ..... E05D 15/0669 16/91
3,805,324 A * 4/1974 Johnson ..... E05D 7/0027 16/244
3,866,658 A * 2/1975 Smith ..... E05D 7/0027 16/249
3,895,670 A * 7/1975 Bales ..... A47G 5/00 16/340
4,064,590 A * 12/1977 Smith ..... E05D 15/264 16/90
4,106,158 A * 8/1978 Kellems ..... E05D 7/0027 16/238
4,386,646 A * 6/1983 Matyas ..... E05D 7/0027 16/249
4,404,771 A * 9/1983 Murase ..... E05D 15/0669 16/105
5,054,163 A * 10/1991 Sterling ..... E05D 7/0027 16/244
5,070,575 A * 12/1991 Redman ..... E05D 15/0634 16/105
5,349,783 A * 9/1994 Jasperson ..... E05D 15/0691 16/105
5,548,869 A * 8/1996 Ryczek ..... E05D 7/0018 16/235
5,678,280 A 10/1997 Haab et al.
7,159,278 B2 * 1/2007 Hilger ..... E05F 7/06 16/102
8,381,354 B2 * 2/2013 Haab ..... E05D 15/0656 16/105
8,522,398 B2 * 9/2013 Haab ..... E05D 15/0634 16/102
9,284,761 B2 * 3/2016 Haab ..... E05D 3/04
9,290,977 B2 3/2016 Haab et al.

* cited by examiner

ADJUSTABLE GUIDE DEVICE FOR A SLIDING ELEMENT

TECHNICAL FIELD

The invention relates to an adjustable guide device for a sliding element, particularly a sliding door, which is slidable along a rail for closing a room opening.

BACKGROUND OF THE INVENTION

For separating or partitioning rooms or for closing room openings or window openings often sliding elements are used, such as sliding doors made of glass or wood, which are typically guided along a rail by means of two carriages. U.S. Pat. No. 9,290,977B2 discloses a device with carriages that are movable along rails. The device allows moving a sliding element in front of a room opening and finally against the room opening in order to close it tightly. The carriages are arranged on the upper side of the sliding element, wherefore the sliding element at the upper side can precisely be guided against the room opening. Hence, in preferred embodiments a seal or sealing gasket provided between the sliding element and the edge of the room opening can be contacted and compressed by a desired degree. In order to precisely execute this operation not only at the upper side, but also at the lower side of the sliding element, a guide device is provided at the lower side of the sliding element, with which the lower side of the sliding element is guided.

Guide devices of this kind, which for example are also disclosed in U.S. Pat. No. 5,678,280A, typically comprise a mounting part and at least one guide member. The mounting part is fastened by mounting screws to the floor and positioned such, that the guide member laterally adjoins the lower side of the sliding element or engages in a groove provided therein so that the sliding element is guided in a defined plane. Due to the fact that after installation often a displacement of the guide device relative to the moving direction of the sliding element is required, the mounting part is often provided with longitudinal slots, through which mounting screws are guided.

In the event that an adjustment is required, the mounting screws are released e.g. by a turn, whereafter the guide device is displaced within an adjustment range that is defined by the length of the longitudinal slots. This adjustment procedure can only be executed when the sliding element has been moved away from the guide device. Then it is estimated by what degree the guide device needs to be displaced. It is therefore possible that the adjustment procedure needs to be repeated with considerable effort several times.

The U.S. Pat. No. 9,290,977B2 discloses as an alternative a guide device with a guide member, which contacts the lower side of the sliding element, as described, with a guide element and which can be rotated relative to the mounting part. For this purpose, the guide member is eccentrically designed, pivotally supported and enclosed within the mounting part and fixable by means of a fixing screw. After releasing the fixing screw the guide member can be turned, until the guide element is positioned as desired. Due to the integration of the eccentrically designed and therefore relatively voluminous guide member a relatively voluminous mounting part results. In spite of this the adjustment range of the guide device is relatively small and amounts to a fraction of the width of the mounting part. Further, adjustment typically also requires a plurality of trials. Furthermore, it needs to be taken care that the guide member does not automatically get released under the impact of force exerted by the sliding element.

WO2012031313 discloses a guide assembly for a folding panel assembly, the guide assembly including a first body section for locating the assembly in a guide channel and a second body section for carrying a bolt that passes through a hinge for attachment to a folding panel, wherein the second body section is pivotally mounted to the first body section so as to adopt either a left or right handed orientation relative to the first body section. This allows replacing two different guide devices by a single guide assembly which can be set either to a first or to a second configuration. In spite of the complex design, this guide assembly, which comprises a joint mechanism and a locking mechanism, does not allow adjustment of the second body section, which can be changed between two opposite positions only.

SUMMARY OF THE INVENTION

Hence, the present invention is based on the object of providing an improved adjustable guide device for a sliding element, particularly for a sliding door. More particularly an adjustable guide device shall be created, with which the sliding element can precisely be guided at its lower side and can be laterally adjusted as required.

It shall be possible to execute the adjustment procedure quickly and precisely and conveniently with little effort. The adjustment procedure shall rapidly lead to an optimal result and repetitive trials can be avoided.

The guide device shall allow access preferably from all directions, even when the guide device is in contact with the sliding element, i.e. the sliding door, and possibly engages in a guide groove or guide rail at the lower side of the sliding element.

The adjustment range shall be wide enough so that a new installation of a guide device, which has not precisely been positioned, is normally not required.

After installation self-acting loosening of the guide device shall be avoided.

Further, the guide device shall be slim, so that little space is required and optionally also the immovable part, i.e. the mounting part of the guide device, can be received in a groove or rail provided at the lower side of the sliding element. The guide device shall optically not appear and still be easily operable.

This problem is solved with a guide device that comprises the features of claim 1. Preferred embodiments of the invention are defined in further claims.

The adjustable guide device, which serves for guiding a sliding element, such as a sliding door, comprises a mounting part, with a mounting body that is mountable on the floor, a guide member that is pivotally connected to the mounting part and that is designed for interacting with the lower side of the sliding element, and a locking element, with which the connection between the mounting part and the guide member is fixable or releasable.

According to the invention the guide member comprises a guide body and a guide foot, which are connected with one another, which guide body comprises a guide column that is aligned along a guide axis and which guide foot is seated on an upper side of the mounting body and is pivotally connected by a joint element to the mounting body so that the guide foot can be turned around a pivot axis, which is distant from the guide axis.

The lower side of the guide foot is preferably provided with a first structured contact surface, which adjoins a second structured contact surface that is provided on the upper side of the mounting body. The two contact surfaces preferably comprise three-dimensional structures, which are complementary to one another, so that the lower side of the guide foot engages in the upper side of the mounting body in a form-locking manner and the guide member is securely held even under the impact of greater forces, e.g. the impact of wind onto the sliding element.

The first and the second contact surfaces comprise structured elements that engage in a form-locking manner into one another, when the mounting part and the guide member are connected.

Hence, the preferably L-shaped guide body is turnable around the pivot axis, i.e. around the front side of the guide foot, so that the guide column, which optionally supports a guide element, can laterally be swivelled out, in order to displace the sliding element into a desired sliding plane. The mounting body and the guide body are arranged upon one another and can have a slim design. The width of the mounting body can advantageously correspond approximately to the diameter of the guide column and/or to the diameter of the guide foot. Hence, the guide device, i.e. particularly the mounting body, can be manufactured with such small dimensions, so that the mounting body can be received fully or partially in a guide groove provided at the lower side of the sliding element.

By releasing the bolt shaped joint element, the guide member is released from a firm coupling with the mounting body and can be turned as required over a relatively wide adjustment range that is dependent from the length of the guide foot, which can be dimensioned according to the dimensions of the mounting body along its longitudinal axis. The longitudinal axis of the installed mounting body is preferably aligned in parallel to the running direction of the sliding element, so that a longer guide foot can be supported. The ratio of the length to the width of the mounting body lies preferably in the range from 1:4 to 1:10. The width of the mounting body is preferably not larger than the width of the guide foot, so that the overall width of the guide device corresponds approximately to the width of the guide foot, when the guide column is not swivelled out.

After installation, the guide device is typically arranged with the guide axis and the pivot axis vertically aligned. The distance between the pivot axis and the guide axis, which are preferably aligned in parallel to one another, lies preferably in a range from 5 mm to 50 mm, further preferred in a range from 15 mm to 25 mm. The length of the guide foot is selected accordingly.

The structures of the contact surfaces are preferably selected such that the guide member can be turned in steps during adjustment procedures and can again be connected in a form-locking manner to the mounting body.

In a particularly preferred embodiment the first and the second contact surfaces comprise structured elements that radially extend towards the pivot axis and that engage in a form-locking manner into one another, when the mounting part and the guide member are connected. The structured elements are preferably formed complementary or inverse to one another and exhibit preferably a waveform, which partially or fully surrounds the pivot axis so that the edges of the wave crests and wave hollows are radially aligned to the pivot axis. Since the guide foot can be swivelled out preferably by a maximum of 90° into the one or other direction and the mounting body is relatively slim, in preferred embodiments the contact surfaces are asymmetrically formed.

The number of the structured elements, e.g. the wave crests and the wave hollows, is preferably selected such, that the guide member can be turned around the mounting body in steps or increments that are in a range from preferably 5° to 15° and then can be fixed. The guide device can be adjusted in a simple manner, by releasing the guide body from the mounting body and by turning it stepwise forwards or backwards and by fixing it finally.

The bolt-shaped joint element is preferably held in a first pivot hole provided in the mounting body, which adjoins the first contact surface or is surrounded therefrom, and in a second pivot hole provided in the guide foot, which adjoins the second contact surface or is surrounded therefrom and is coaxially aligned to the pivot axis.

The shaft of the joint bolt preferably comprises a threaded member, which extends into a recess provided in the mounting body. In the recess a locking element, in the form of a nut can be provided that can be turned over the threaded member. By fastening the fixing element the bolt head of the joint bolt can be pressed against the guide foot, so that the first and the second structured contact surfaces are pressed against one another. After releasing the fixing element and the first and second contact surfaces from one another, the guide member can be turned or adjusted as required. The locking element, e.g. the nut, which lies freely in a recess at a height approximately in the centre or the lower side of the mounting body, can be grasped and turned by means of a tool, e.g. an open-ended wrench, in order to release or fasten the guide member. The tool can be guided below the lower edge of the sliding element towards the locking element in order to grasp the locking element. Hence, at the lower side of the sliding element only a small gap of only a few millimetres height needs to be provided, which allows moving the tool towards the locking element.

To ensure that the locking element is easily accessible, the pivot axis is located at the end of the mounting body, while receiving openings in the mounting body, which serve for receiving mounting screws, are arranged in the middle and/or on the other end of the mounting body.

Preferably, the first pivot hole is provided on a freely exposed cantilever, which extends at one end of the mounting body along its longitudinal axis. Below the cantilever said recess is provided, which serves for receiving the locking element, e.g. the nut. The cantilever, which exhibits the first structured contact surface at its upper side, is preferably an integral part of the mounting body. However, the mounting part can have a modular structure and can be connected to the cantilever e.g. by means of one of the mounting screws.

Below the cantilever the mounting body is preferably connected to a securing ring that is provided with a ring opening, which is coaxially aligned with the first and to the second pivot hole. The securing ring serves for receiving an end piece of the joint element, i.e. of the joint bolt. The end piece of the joint bolt forms a securing member, which is held axially movable in the securing ring and which prevents the locking element, which is securely held between the cantilever and the securing ring, to escape from the recess. If the locking element gets released from the threaded member, then it is held by the securing member and the securing ring and can easily be screwed again onto the threaded member.

The guide body and the joint element can be connected with one another integrally or by mechanical connecting means, e.g. by a press fitting. The joint element, i.e. the joint bolt preferably comprises a connecting member, which is held in the first pivot hole by press fitting.

The guide body and the joint element can also comprise form elements which correspond to one another and by which a stable connection between the guide body and the joint element can be established. Hence forces acting on the guide body can directly be transferred to the mounting body, which preferably is connected by means of at least two mounting screws to the floor.

In a further preferred embodiment the mounting body comprises a bearing shell which preferably is aligned in parallel to the guide column and which adjoins the guide foot and introduces acting forces into the mounting body. In this way load is advantageously relieved from the joint connection.

The guide column can be provided in the embodiment of a guide element and can exhibit different forms and/or can support running elements, such as rollers or wheels, or gliding elements, such as wing elements or plastic coatings. Hence, the guide column can exhibit a simple column form with any cross-section, e.g. a wing form, or can be equipped with one or a plurality of guide elements, which abut the lower side of the sliding element on one side or both sides or which are guided in a guide groove or guide rail provided therein.

The guide column is preferably provided with an axial bore, in which a shaft is seated, which rotatably holds a guide roller or a guide wheel.

In a further preferred embodiment the guide column is adjustable in height. Preferably two or more column elements are provided, which can be screwed or coupled with one another in a selectable distance and can be fixed.

BRIEF DESCRIPTION OF THE DRAWINGS

The invention is described below in detail with reference to the drawings, wherein.

DETAILED DESCRIPTION

Figure 1:
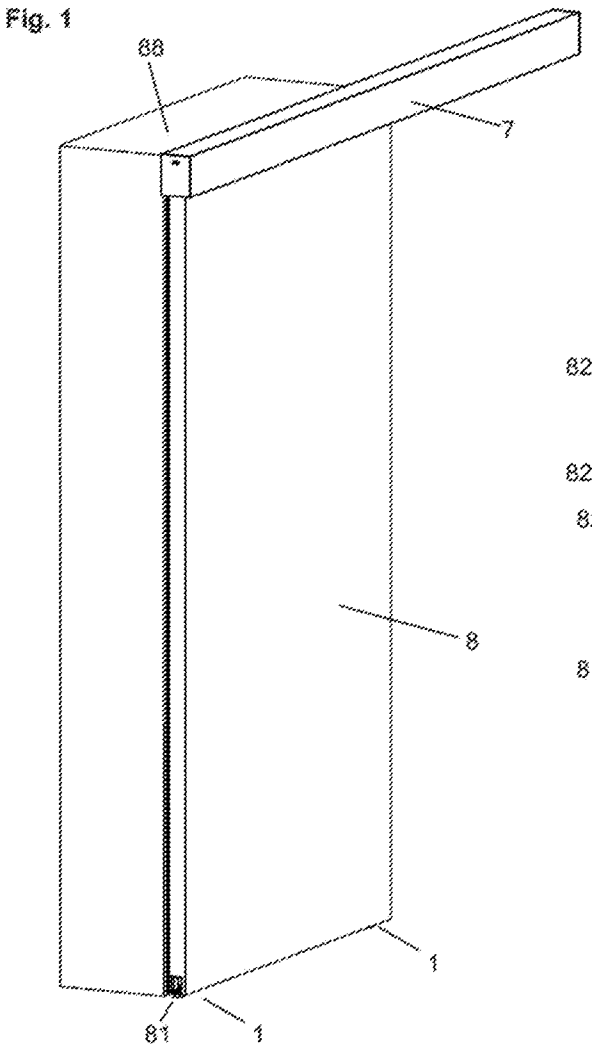
FIG. 1 shows a sliding element, i.e. a sliding door 8, which is held slidable by means of a sliding system 7 in front of a door frame 88, and which exhibits at the lower side a guide groove 81, which is opened downwards and in which inventive guide devices 1 are engaged, which are mounted at the floor.

FIG. 1 shows a sliding element, i.e. a sliding door 8, which is slidably held in front of a door frame 88 by means of a sliding system 7, as shown for example in U.S. Pat. No. 9,290,977B2. The sliding system 7 comprises for example two carriages, which are connected to the sliding element 8 and which are guided by means of one or a plurality of rails along a pathway. The displacement can thereby be executed in parallel to a room opening or in parallel to the room opening up to a closing phase, in which the sliding element in addition is guided against the room opening. In order to tightly close the room opening, it is required that the sliding element is precisely guided at the upper side and at the lower side and is guided in a given distance to the room opening, i.e. to a door frame or a casing 88 provided there. For precisely guiding the sliding element 8 at the lower side, two inventive guide devices 1 are provided at the floor, which engage into a guide groove 81 that has been machined into the lower side of the sliding element 8.

The guide groove 81 shown in FIG. 1 is open at the front side. As an alternative, in the embodiment of FIG. 2, the guide groove 81 is closed at the front side 83 of the sliding element 8. As described below, in both alternatives convenient access is provided to the guide device 1 for adjustment purposes (see FIG. 3).

Figure 2:
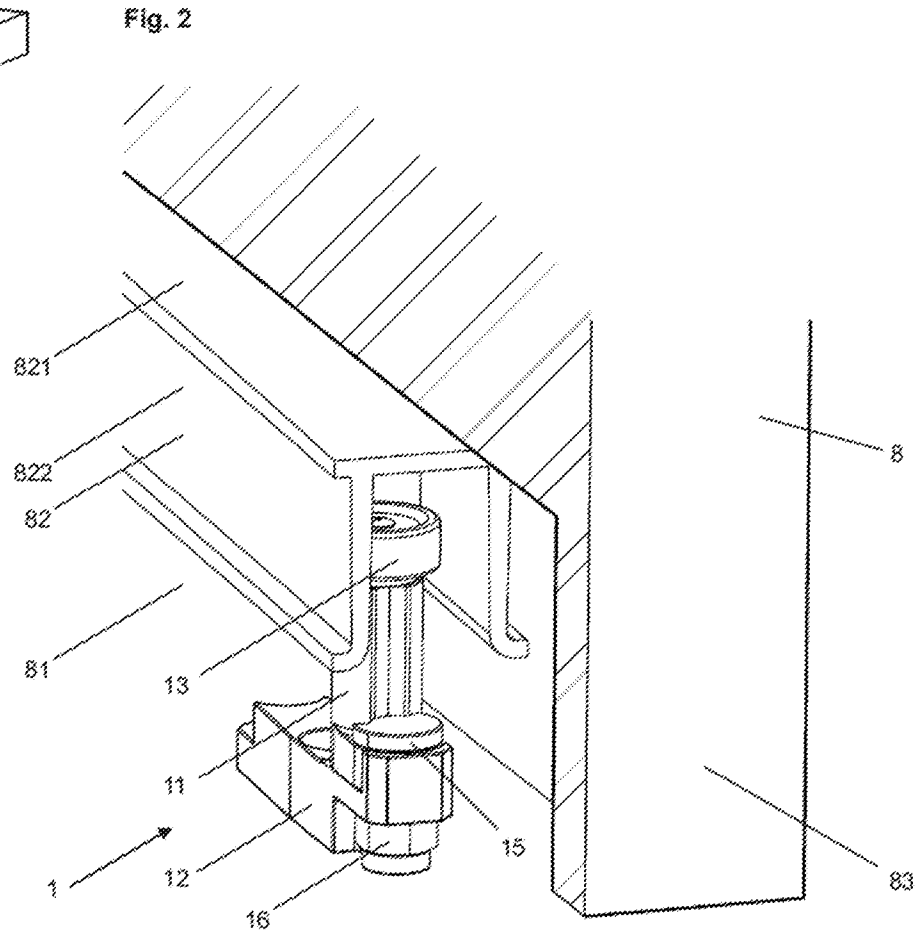
FIG. 2 shows one of the guide devices 1 of FIG. 1, which engages at the lower side into a guide groove 81 of a sliding door 8 shown in longitudinal section, in which a guide rail 82 is provided and which in this embodiment is closed at the front side 83 of the sliding door 8.

FIG. 2 shows one of the guide devices 1 of FIG. 1, which engages at the lower side into a guide groove 81 of a sliding door 8 shown in longitudinal section, in which a guide rail 82 is provided. The guide rail 82 exhibits a U-profile that is opened downwards, with an intermediate member 821 and side members 822 laterally connected thereto, whose inner sides form running surfaces for guide elements 13. Below the guide rail 82, which for example is screwed to the sliding element, a rather large space is kept free within the guide groove 81, in which the guide device 1 is received partly or completely. Between the lower side of the sliding element 81 and the floor a gap is kept free, through which a tool can be guided (see FIG. 3). Due to the advantageous construction of the guide device 1, this gap can have little height allowing only the transfer of the tool.

The guide device 1 shown in FIG. 2 comprises a mounting part 12 mountable at the floor and a guide member 11, which is rotatably connected by means of a joint element 15 to the mounting part 12 and which is lockable by means of a fixing element 16. The guide member 11 is provided with a guide element, i.e. a guide wheel 13, which is guided within the guide rail 82 and can roll along its sidewalls 822.

Figure 3:
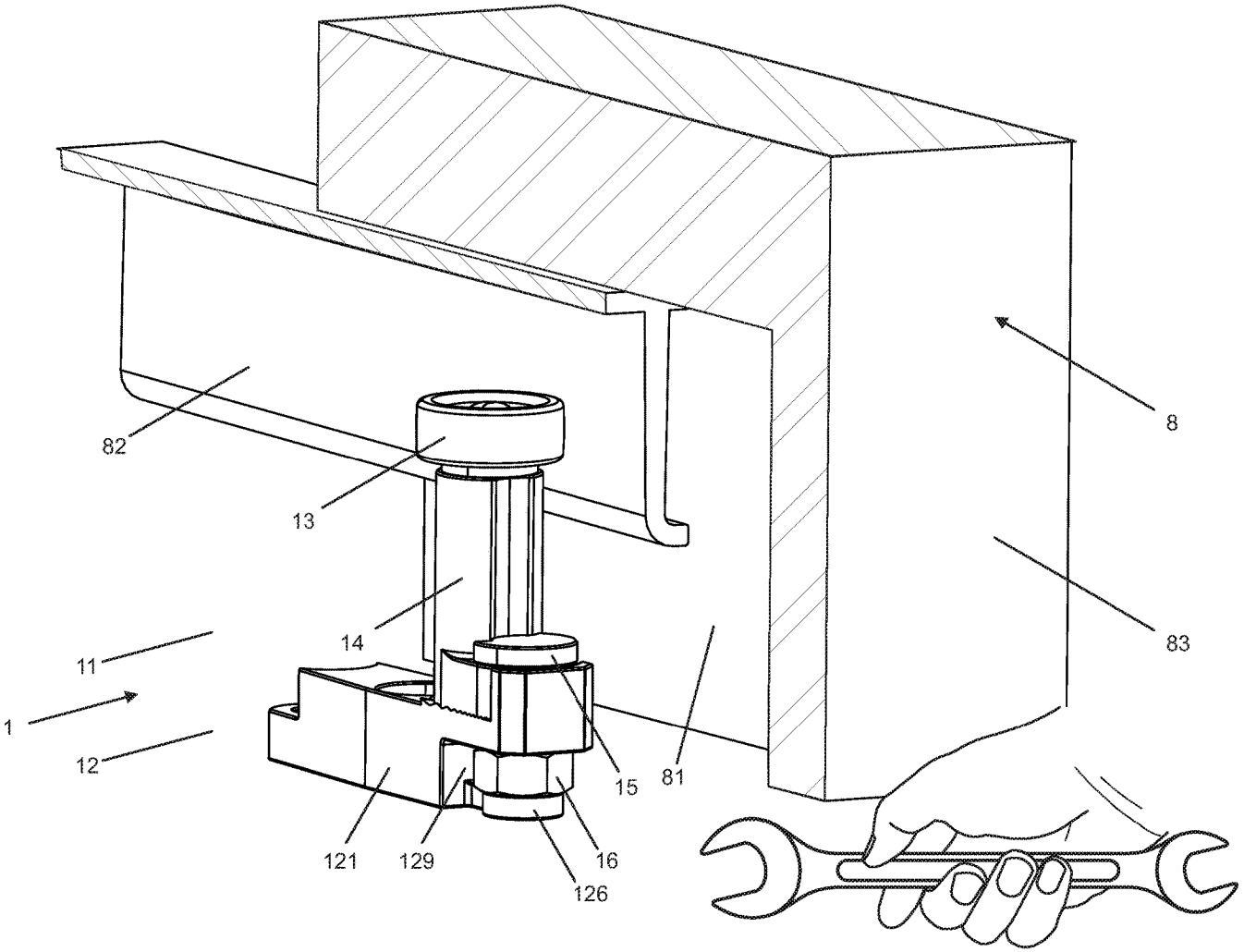
FIG. 3 shows the guide device 1 of FIG. 2 with the guide member 11, which engages with a guide element, i.e. a guide wheel 13 in the guide rail 82 shown in a longitudinal section, and a mounting part 12, which is mounted at the floor and connected by a joint element 15 with the guide member 11.

FIG. 3 shows the guide device 1 of FIG. 2 with the guide member 11, which engages with a guide wheel 13, which is supported by a guide body 14, into the guide rail 82, which is shown in longitudinal section. The mounting part 12, which is mounted at the floor by means of two mounting screws 9 (see FIG. 7*a*), comprises a mounting body 121, which at its lower side is provided with a recess 129. In the recess 129 the locking element, i.e. the nut 16 is provided, with which the threaded bolt 15 is fastened and the guide body 14 can be fixed on the mounting body 121.

Optionally a securing ring 126, which is connected to the mounting body 121, extends into the recess 129, which however exhibits only a little height. Hence, the nut 16 is held practically directly above the floor and can be grasped and turned with a tool, e.g. the open-ended wrench shown. The open-ended wrench can be guided below the door laterally or from the front side, in order to release or fasten the nut 16. Hence, although the guide device 1 does optically not appear it can conveniently be operated, i.e. adjusted. The guide wheel 13 is guided within the guide rail 82, the guide body 14 is received completely and the slim mounting body 121 to a major part in the guide groove 81 and is invisible from the outside.

Figure 4B:
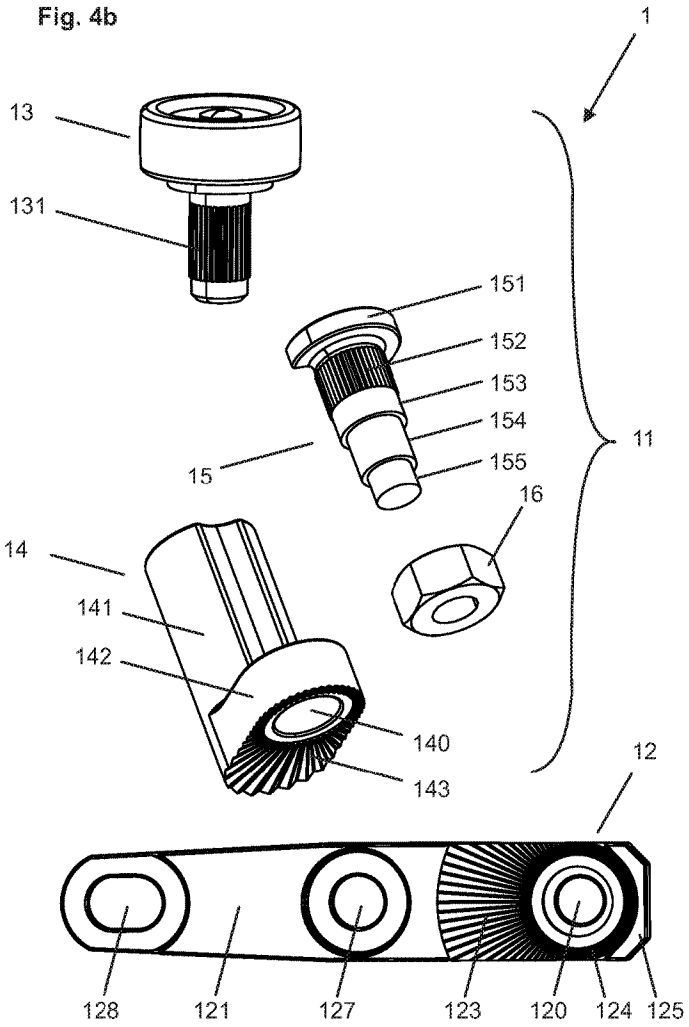
FIG. 4*b* shows the guide device 1 of FIG. 4*a* with the elements of the guide member 11 and the mounting part 12 from a different angle.
Figure 4A:
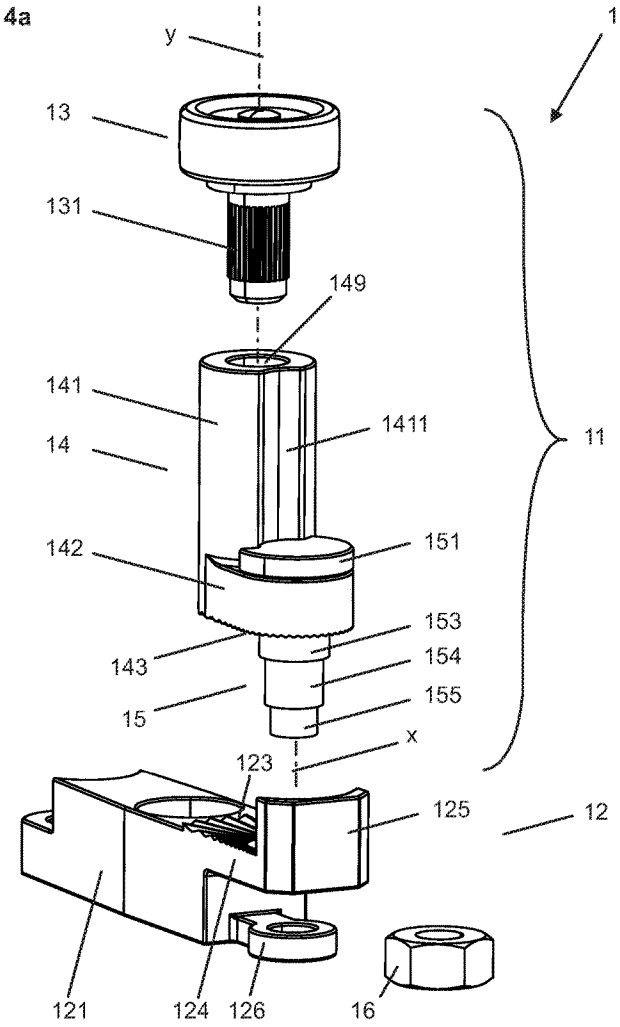
FIG. 4*a* shows the guide device 1 of FIG. 2 in explosion view.

FIG. 4*a* and FIG. 4*b* show the guide device 1 of FIG. 2 in explosion view with the mounting body 121 of the mounting part 12 and the guide member 11, which comprises the guide body 14 that is firmly connected to the joint element, i.e. the joint bolt 15, and the guide element, i.e. guide wheel 13 that is held by a shaft 131. Further shown is the locking element 16, with which the joint bolt 15 can be fastened. In FIG. 4*a*, the device parts, except the fixing element 16, are elevated in vertical direction, whereby, on the one hand, the guide body 141 and the joint bolt 15, and, on the other hand, the shaft 131 and the guide wheel 13 are connected with one another.

In FIG. 4*b*, the device parts are turned against one another in order to improve the view to the relevant features.

The guide body 14 comprises a guide column 141 and a guide foot 142 that is connected in one part to the guide column 141. The guide foot 142 is placed onto the upper side of the mounting body 121 and is therefore not integrated into the mounting body 121. Hence, an elongated and symmetric mounting body 121 can be provided with a slim design. FIG. 7*a* shows that the width of the mounting body 121 corresponds approximately to the diameter of the guide column 141. Hence, in comparison to the guide groove 81 provided at the lower side of the sliding element 8, the guide device 1 is designed very narrow and can still be adjusted over a wide range.

The guide foot 142 is provided with a pivot hole, i.e. pivot bore 140 (see FIG. 4*b*), through which the shaft 152, 153, 154, 155 of the joint bolt 15 has been inserted.

FIG. 4*b* shows that the shaft of the joint bolt 15 comprises a plurality of axially displaced shaft members 152, 153, 154 and 155, which are stepped relative to one another and which fulfil different functions. Shaft member 152 is a connecting member with vertically extending furrows, which are deformed under pressure within the pivot bore 140 of the guide foot 142, so that a stable connection results, which is not releasable during operation of the guide device 1. FIG. 4*a* shows the guide body 141 and the joint bolt as a unity. For securing and taking load off this connection a form-locking connection between the guide body 141 and the joint bolt 15 is provided in addition. The guide column 141 is provided with a coupling groove 1411 that extends in parallel to the longitudinal axis y and that is facing the pivot bore 140, i.e. the bolt head 151. The bolt head 151 is provided with a cut that corresponds to the form of the coupling groove 1411. Hence, the bolt head 151 is held in a form-locking manner in the coupling groove 1411 and cannot be turned, whereby load on the connection between the connecting member 152 of the shaft of the joint bolt 15 and the guide foot 142 is reduced, when forces are acting.

The passage member 153 of the shaft of the joint bolt 15, which adjoins the connecting member 152 with reduced diameter, is rotatably held within a pivot bore 120 provided in the mounting body 121.

The threaded member 154, which adjoins the passage member 153 with reduced diameter, serves for interacting with the nut 16. The securing member 155, which adjoins the threaded member 154 with reduced diameter, serves for the introduction into the securing ring 126, which assures that the nut 16 when released from the threaded member 154 cannot escape. Hence, the nut 16 is held between a cantilever 124 of the mounting body 121, which is provided with the related pivot bore 120, and the securing ring 126. The cantilever 124 and the securing ring 126 are preferably integral members of the mounting body 121 or are members of modules which are connected to the mounting body 121 in a form-locking manner and are fixed, e.g. by means of one of the mounting screws 9. For the introduction of the mounting screws 9, the mounting body 121 is provided with mounting bores 127, 128. The first mounting bore 127 is provided approximately in the centre of the mounting body 121. The second mounting bore 128 is provided at the end of the mounting body 121, which lies opposite to the end of the mounting body 121, at which the cantilever 124 is provided. Hence, the mounting body 121 is built as a kind of springboard with a pedestal that is mounting with the mounting screws 9 at the floor and with a stable cantilever 124, which forms the springboard. Further, a bearing shell 125 is provided, which adjoins the cantilever 124 at the front side and with which at least one sided a form-locking connection between the guide foot 142 and the mounting body 121 is reached, which again reduces the load on the connection between the joint bolt 15 and, on the one hand, the mounting body 121 and, on the other hand, the guide body 14.

In the embodiment shown, structured contact surfaces 143, 123 are provided at the lower side of the guide foot 142 and at the upper side of the mounting body 121, i.e. of the cantilever 124, which comprise forms that are complementary to one another and which engage in different turning positions of the guide foot 142 relative to the mounting body 121 always in a form-locking manner into one another. The structures of the contact surfaces 123, 143 exhibit regularly arranged structured elements, which correspond to one another, i.e. which are complementary to one another. For this purpose, mutually complementary depressions and elevations may uniformly be repeated several times. The recesses may be openings, bores, or wave hollows. In contrast, the elevations may be formations, cones or wave crests. Bores and cones engaging into one another result in good form-locking connections. However, such structured elements are not easily released from one another for the purpose of making adjustments. Particularly advantageous are therefore wave forms, which are easily releasable from one another and with which good form-locking connections can still be achieved.

In the preferred embodiment shown, the first and the second contact surfaces 123; 143 comprise structured elements that radially extend to the pivot axis x and that engage in a form-locking manner into one another, after the connection of the mounting part 12 and the guide member 11 has been established.

In a particularly preferred embodiment wave-shaped structured elements are provided, which partially or, as shown in FIG. 4*b*, completely surround the pivot axis x, i.e. the pivot bores 120, 140. The wave crests and wave hollows always extend radially to the pivot axis x, whereby the extension in direction to the mounting bores 127, 128 is largest and is significantly reduced laterally and in direction to the bearing shell 125. Hence, the contact surfaces 123, 143 with their structured elements are therefore designed asymmetrically with reference to the pivot axis x.

Number and form of the structured elements are selected such, that the guide member 11 is turnable around the mounting body 121 stepwise with increments in a range from preferably 5° to 15° and is fixable. Preferably, the structured elements are an integral part of the mounting body 121 and of the guide foot 142 and in preferred embodiments are coated or processed, e.g. hardened. Alternatively, the structured elements can also be provided on a module, which is connected to the mounting body 121, i.e. the guide foot 142.

The guide column 141 and the shaft 131 of the guide element 13, which can be inserted into an axial bore 149 provided at the upper side of the guide column 141, are coaxially aligned with their longitudinal axes to a guide axis y, which after installation of the guide device 1 is normally vertically aligned. The shaft 152, 153, 154, 155 of the joint bolt 15 however defines a pivot axis x, around which the guide body 14, i.e. the guide column 141, is turnable after the joint bolt 15 has been released. The distance between the pivot axis x and the guide axis y lies preferably in a range from 5 mm to 25 mm, further preferred in a range from 10 mm to 20 mm. The length of the guide foot 142 is dimensioned accordingly.

Hence, after releasing the fixing element 16, the guide member 14 can be turned to the one or the other side preferably by at least approximately +/−90° to the outside, so that the guide axis y, which defines the sliding plane of the sliding element 8, can be displaced outwards by a corresponding degree to the one or the other side.

Figure 5:
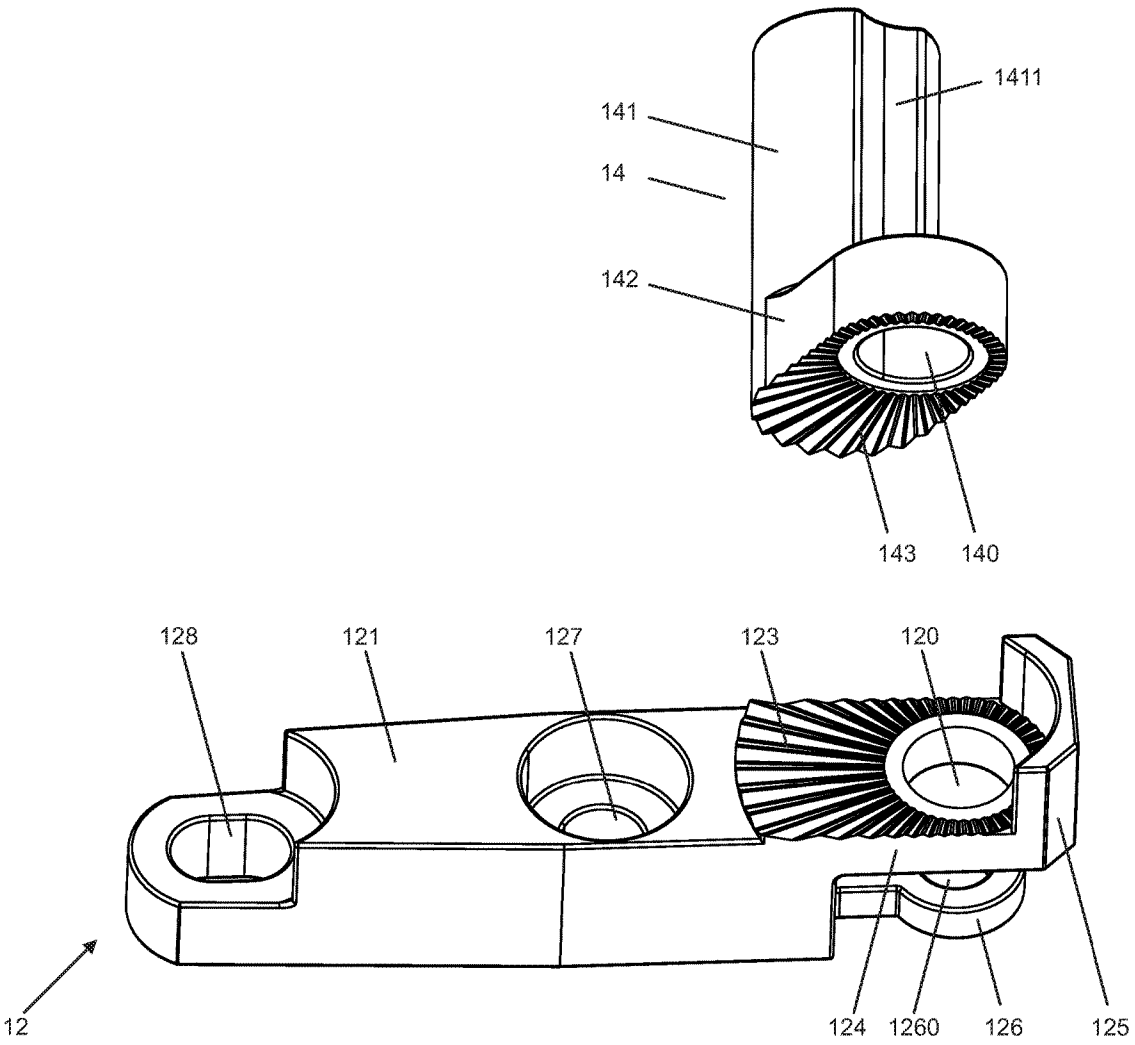
FIG. 5 shows the mounting part 12 and a guide body 14 of the guide member 1 with structured contact surfaces 123, 143 that are facing one another.

FIG. 5 shows the mounting body 121 with the cantilever 124 provided with the first wave shaped structured contact surface 123 at its upper side, and the guide body 14 with the guide foot 142 provided with the second wave shaped structured contact surface 143 at its lower side. Below the cantilever 124, the securing ring 126 with a ring opening 1260 is shown, which serves for receiving the securing member 155 of the shaft of the joint bolt 15.

Figure 6:
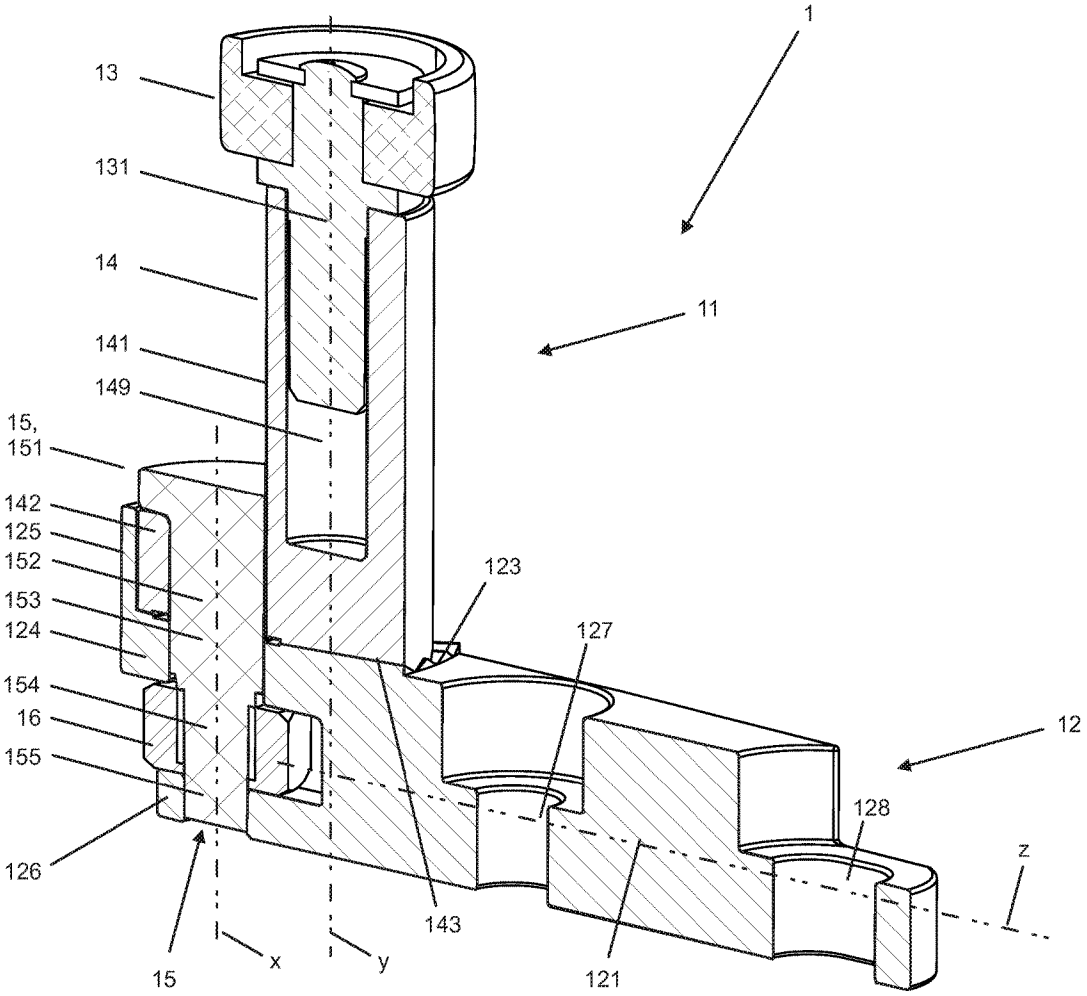
FIG. 6 shows the guide device of FIG. 2 with a cut along cutting line A--A shown in FIG. 7*a;*

FIG. 6 shows in sectional view the guide device of FIG. 2 cut along line A--A shown in FIG. 7*a*. Shown are the elements of the joint bolt 15 with connecting member 152 received by the guide foot 142, passage member 153 received by the mounting body 121, i.e. the cantilever 124, threaded member 154 connected to the nut 16 and securing member 155 held in the securing ring 126. Further drawn is pivot axis x which extends coaxially to the joint bolt 15. It is further shown that the shaft 131 of the guide element, i.e. of the guide wheel 13 is inserted into the axial bore 149 provided in the guide column 141. It is further shown that guide foot 142 with the second contact surface 141 at its lower side is seated on the first contact surface 123 provided at the upper side of the mounting body 121. Further the guide axis y is shown, which coaxially extends through the guide column 141 and the shaft 131.

The pivot axis x and the guide axis y are located distant from one another and are aligned in parallel to one another. The guide member 11 is held centrally above the mounting body 121 and is not swivelled out to the one or the other side, wherefore the guide axis y intersects the longitudinal axis z of the mounting body 121, which also intersects the pivot axis x regardless of the turning position of the guide member 11. The distance between the pivot axis x and the guide axis y corresponds at least approximately to the diameter of the guide column 141 and coarsely also to the diameter of the guide wheel 13. Hence, the guide axis y can be swivelled approximately by half the width of the mounting body 121 to the one or the other side, so that a relatively large adjustment range results, with which even larger deviations of the guide device 1 from a correct position can be compensated.

FIG. 7*a* shows the guide device of FIG. 2 with the guide member 11 without swivelling out.

Figure 7B:
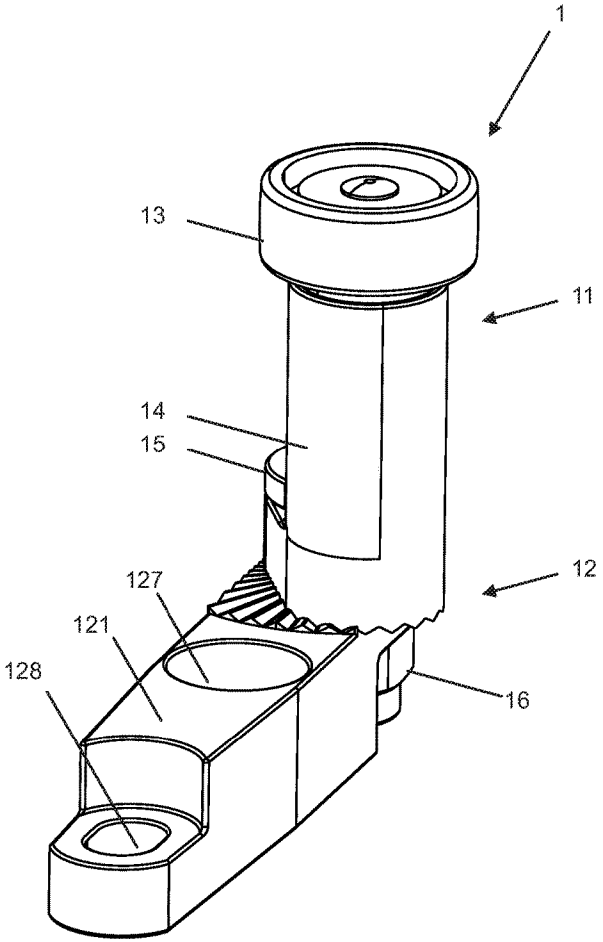
FIG. 7*b* shows the guide device of FIG. 2 with the guide member 11 turned to the right side.
Figure 7A:
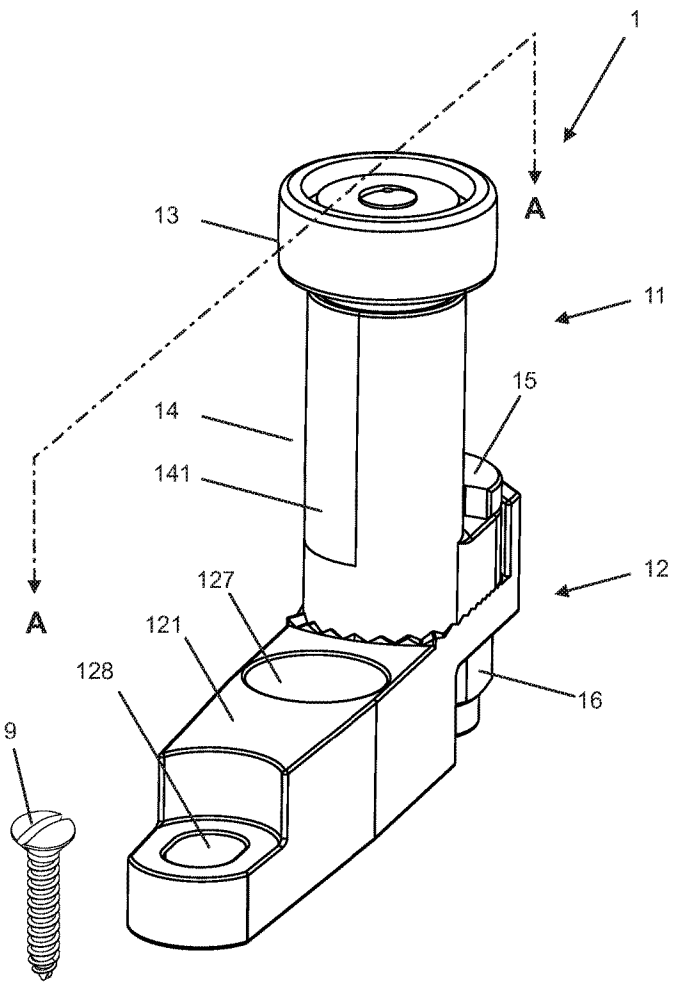
FIG. 7*a* shows the guide device of FIG. 2 with the guide member 11 not swivelled out.

FIG. 7*b* shows the guide device of FIG. 2 with the guide member 11 turned to the right side.

LIST OF REFERENCES

1 guide device
11 guide member
12 mounting part
120 first pivot hole
121 mounting body
123 first structured contact surface
124 cantilever
125 bearing shell
126 securing ring
1260 ring opening
127, 128 receiving openings
129 recess
13 guide element, guide wheel
131 shaft
14 guide body
140 second pivot hole
141 guide column
1411 coupling groove
142 guide foot
143 second structured contact surface
149 axial bore
15 joint element, preferably joint bolt
151 bolt head
152 connecting member
153 passage member
154 threaded member
155 securing member
16 locking element
7 guide system with guide rails and carriages
8 sliding element, sliding door
81 guide groove
82 guide rail
821 intermediate member of the guide rail 8
822 lateral members of the guide rail 8
83 front side of the guide groove 81 (open/closed)
88 frame
9 claims
x pivot axis
y guide axis

The invention claimed is:

1. Adjustable guide device for a sliding element, such as a sliding door, with a mounting part, which comprises an elongated mounting body that is mountable on the floor, with a guide member that is pivotally connected to the mounting part and that is designed for interacting with the lower side of the sliding element, and with a locking element with which the connection between the mounting part and the guide member is fixable or releasable, wherein the guide member comprises a guide body and a guide foot, which are connected with one another, which guide body comprises a guide column that is aligned along a guide axis (y) and which guide foot is seated on an upper side of the mounting body and is pivotally connected by a joint element to the mounting body so that the guide foot can be turned around a pivot axis (x), which is distant from the guide axis (y) and wherein on a lower side of the guide foot a first structured contact surface is provided, which adjoins a second structured contact surface that is provided on the upper side of the mounting body, which first and second contact surfaces comprise a plurality of structured elements that engage in a form-locking manner into one another, when the mounting part and the guide member are connected.

2. Guide device according to claim 1, wherein the guide axis (y) and the pivot axis (x) are aligned in parallel to one another.

3. Guide device according to claim 1, wherein the structured elements are aligned radially to the pivot axis (x).

4. Guide device according to claim 1, wherein the number of the structured elements, which encircle the pivot axis (x) in a wave form, are selected such that the guide member is adjustably turnable and fixable with increments in a range from 5°-15° around the pivot axis (x).

5. Guide device according to claim 1, wherein the joint element is bolt shaped and is held coaxially aligned to the pivot axis (x) in a first pivot hole in the mounting body, which adjoins the second contact surface or is enclosed by the second contact surface, and in a second pivot hole in the guide foot, which adjoins the first contact surface or is enclosed by the first contact surface.

6. Guide device according to claim 5, wherein the bolt-shaped joint element comprises a bolt head that adjoins an upper side of the guide foot and that the mounting body comprises a cantilever at one end on which the first contact surface is provided, and that the locking element is provided below the cantilever in the form of a nut, which encloses a threaded member of the joint element.

7. Guide device according to claim 6, wherein the mounting body is connected to a securing ring, which is held below the cantilever and which is provided with a ring opening that is coaxially aligned to the first and second pivot holes and that encloses a securing member of the bolt shaped joint element, whereby the locking element is held secured between the cantilever and the securing ring.

8. Guide device according to claim 1, wherein the width of the elongated mounting body corresponds approximately to the width the guide column.

9. Guide device according to one of the claims 1, wherein the width of the elongated mounting body corresponds approximately to the width of the guide foot.

10. Guide device according to claim 1, wherein the guide body and the joint element are integrally connected with one another or wherein the guide body and the joint element are connected by mechanical connecting means.

11. Guide device according to claim 1, wherein the guide body and the joint element comprise form elements which are complementary to one another.

12. Guide device according to claim 1, wherein the mounting body comprises a bearing shell which adjoins the guide foot.

13. Guide device according to claim 1, wherein the guide column serves as guide element or that the guide column holds at least one guide element, such as a guide wheel or a gliding element.

14. Guide device according to claim 13, wherein the guide column is provided with an axial bore, in which a shaft is inserted that rotatably holds the guide wheel.

15. Guide device according to claim 1, wherein the guide column is adjustable in height and comprises two column elements that are adjustably screwed or adjustably coupleable to one another.

* * * * *